US010428731B2

(12) United States Patent
Moon

(10) Patent No.: US 10,428,731 B2
(45) Date of Patent: Oct. 1, 2019

(54) METHOD FOR CLEANING CONTINUOUSLY VARIABLE VALVE TIMING SYSTEM

(71) Applicants: HYUNDAI MOTOR COMPANY, Seoul (KR); KIA MOTORS CORPORATION, Seoul (KR)

(72) Inventor: Chi-Ho Moon, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 29 days.

(21) Appl. No.: 15/835,037

(22) Filed: Dec. 7, 2017

(65) Prior Publication Data

US 2018/0298815 A1 Oct. 18, 2018

(30) Foreign Application Priority Data

Apr. 13, 2017 (KR) ..... 10-2017-0047771

(51) Int. Cl.

| | |
|---|---|
| ***F02B 77/04*** | (2006.01) |
| ***F02D 13/02*** | (2006.01) |
| ***F01L 1/344*** | (2006.01) |
| ***F02D 41/04*** | (2006.01) |
| ***F02D 41/24*** | (2006.01) |
| *F02D 41/00* | (2006.01) |

(52) U.S. Cl.

CPC ..... *F02B 77/04* (2013.01); *F01L 1/3442* (2013.01); *F02D 13/0219* (2013.01); *F02D 13/0246* (2013.01); *F02D 41/04* (2013.01); *F02D 41/2464* (2013.01); *F01L 2001/34426* (2013.01); *F01L 2001/34443* (2013.01); *F01L 2001/34453* (2013.01); *F01L 2001/34463* (2013.01); *F01L 2001/34466* (2013.01); *F01L 2001/34469* (2013.01); *F01L 2250/02* (2013.01); *F01L 2800/05* (2013.01); *F01L 2800/17* (2013.01); *F01L 2820/01* (2013.01); *F01L 2820/041* (2013.01); *F01L 2820/042* (2013.01); *F02D 2041/001* (2013.01)

(58) Field of Classification Search

CPC combination set(s) only.
See application file for complete search history.

(56) References Cited

U.S. PATENT DOCUMENTS

2003/0066501 A1* 4/2003 Park ..... F01L 1/3442 123/90.17
2011/0023805 A1* 2/2011 Takemura ..... F01L 1/3442 123/90.17

FOREIGN PATENT DOCUMENTS

KR 2003-0030203 A 4/2003
KR 10-1637837 B1 7/2016

* cited by examiner

*Primary Examiner* — Erin F Bergner
(74) *Attorney, Agent, or Firm* — Morgan, Lewis & Bockius LLP

(57) ABSTRACT

A method for cleaning a continuously variable valve timing (CVVT) system for removing foreign materials includes: switching a target operating value of the CVVT system to a predetermined setting value within a set operating region and performing cleaning of the CVVT system; and determining whether a valve timing control learning request exists for the CVVT system, and, when the valve timing control learning request exists, aborting the cleaning.

12 Claims, 4 Drawing Sheets

-Prior Art-

METHOD FOR CLEANING CONTINUOUSLY VARIABLE VALVE TIMING SYSTEM

CROSS-REFERENCE TO RELATED APPLICATIONS

This application claims the benefit of priority to Korean Patent Application No. 10-2017-0047771, filed on Apr. 13, 2017 which is incorporated herein by reference in its entirety.

TECHNICAL FIELD

The present disclosure relates to a method for cleaning a continuously variable valve timing (CVVT) system, and more particularly, to a method for cleaning a CVVT system, which is capable of considering whether a valve lift learning performing request exists while cleaning is performed to remove foreign materials stacked at an oil control valve of the CVVT system.

BACKGROUND

Generally, valve opening and closing timings are set in order to enable an engine to obtain a maximum output at a specific rotation region (for example, specific revolutions per minute (RPM)). Therefore, in a low-speed rotation region, the valve opening and closing timings should be retarded for expansion and explosion of a mixture, while in a high-speed rotation region, the valve opening and closing timings should be advanced for discharge of the exploded mixture. However, when valve opening and closing timings are adjusted to a low speed, discharge of a mixture is retarded during a high-speed rotation, and, when the valve opening and closing timings are adjusted to a high speed, compression of the mixture is retarded during a low-speed rotation to cause significant degradation in efficiency of an engine.

To resolve such a problem, a continuously variable valve timing (CVVT) system is proposed in a manner that enables an engine to obtain high efficiency and high output at a high speed as well as a low speed by adjusting valve opening and closing timings in synchronization with the number of revolutions of the engine.

A CVVT mechanism is generally configured with a rotor vane mounted at one end part of a cam shaft, and a housing mounted at the rotor vane to form a retard angle chamber and an advance angle chamber inside the housing. Further, valve opening and closing timings are adjusted by controlling a pressure of oil that is supplied to the advance angle chamber and the retard angle chamber inside the housing by an oil control valve.

However, when foreign materials contained in the oil are stacked inside the oil control valve or in an oil flow path of the CVVT system, the CVVT system does not operate smoothly. To resolve such a problem, a related art discloses that a cleaning mode is performed to remove various kinds of foreign materials which are stacked between an oil flow path and a spool inside an oil control valve by moving the spool of the oil control valve a number of times from a full closed position (that is, a duty cycle of 0%) to a full open position (that is, a duty cycle of 100%), and vice versa by a control signal that is transmitted from an electronic control unit to the oil control valve.

Meanwhile, there occurs a case in which positions of an intake cam and an exhaust cam according to controlling of an oil control valve are varied due to causes such as extension of a timing chain that connects between a CVVT system and a cam shaft of an intake system, and the like. In this case, to compensate for a position of the cam shaft according to a control duty of the oil control valve, a controller performs learning of the CVVT system.

Typically, cleaning of the CVVT system and the above-described learning thereof are respectively performed in set operating regions. Further, when both the cleaning and the learning of the CVVT system are performed by a set number of times, they are not performed any longer.

However, when an operating region for the cleaning of the CVVT system is similar to that for the learning of the CVVT system and, as shown in FIG. 2, the cleaning and the learning of the CVVT system are performed at the same time, the learning has a priority higher than that of the cleaning so that a timing control of a continuously variable valve for the learning may be performed instead of the cleaning. Meanwhile, even though the timing control for the learning may be performed instead of the cleaning, the controller does not recognize such a situation to incorrectly recognize that a predetermined cleaning operation is performed based on a cleaning request signal.

Consequently, as shown in FIG. 2, even though the cleaning is not performed and the learning is actually performed, the number of times the cleaning is performed is counted to cause a reduction in an actual number of times the cleaning is performed. As a result, foreign materials are stacked inside the oil control valve to adversely affect durability of the oil control valve.

SUMMARY

The present disclosure is directed to a method for cleaning a continuously variable valve timing (CVVT) system, which is capable of preventing degradation of durability due to stacking of foreign materials.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, a method for cleaning a CVVT system to remove foreign materials, includes: switching a target operating value of the CVVT system to a predetermined setting value within a set operating region and cleaning the CVVT system; and determining whether a valve timing control learning request exists for the CVVT system, and aborting the cleaning when the valve timing control learning request exists.

The cleaning may control to move a spool of an oil control valve within a predetermined region by a predetermined number of times according to a control signal applied to the oil control valve of the CVVT system to perform cleaning of the oil control valve.

The method may further include determining whether a cleaning condition is satisfied before the cleaning is performed, and, when the cleaning condition is satisfied, the cleaning is performed.

When the valve timing control learning request exists and thus the cleaning is aborted, variables related to the performing of the cleaning may be initialized.

Whether the valve timing control learning request exists may be continuously verified while the cleaning is performed, and, when the valve timing control learning request exists while the cleaning is performed, the performing of the cleaning may be aborted.

A valve timing control learning for the CVVT system may be performed by varying a duty ratio of the oil control valve to adjust a target rotation phase of a cam shaft by the CVVT system to a target learning phase, and then detecting an actual rotation phase of the cam shaft, so that a relationship between the varied duty ratio of the oil control valve and the detected actual rotation phase of the cam shaft in a corresponding operating region is identified.

When the cleaning is completed, a counter representing the number of times the cleaning is performed may be increased.

While the cleaning is performed, a high duty cycle and a low duty cycle of the control signal applied to the oil control valve may be switched by one times and over so that a position of the spool of the oil control valve may be controlled to move within a predetermined section by a predetermined number of times and over.

The method according to the present disclosure may further include determining whether the switching between the high duty cycle and the low duty cycle is performed by a predetermined number of times after the cleaning is performed.

After the valve timing control learning request exists for the CVVT system and thus the cleaning is aborted, when the valve timing control learning is determined to be terminated, the cleaning may be resumed.

The target learning phase in the valve timing control learning for the CVVT system may be a phase corresponding to a mechanical stop position of a valve lift that is controlled by the CVVT system.

The spool may be controlled to switch and move between a full closed position and a full open position by a predetermined number of times.

When the number of times the cleaning is performed exceeds a predetermined number of times, the cleaning may be aborted for more than a predetermined time.

When the valve timing control learning request exists for the CVVT system while the cleaning is performed, a final target phase of the CVVT system may be determined based on the target learning phase in the valve timing control learning.

The valve timing control learning for the CVVT system may be performed in a preset operating region of an engine.

DETAILED DESCRIPTION OF SPECIFIC EMBODIMENTS

Hereinafter, a method for cleaning a continuously variable valve timing (CVVT) system according to an exemplary embodiment of the present disclosure will be described with reference to the accompanying drawings.

Figure 1:
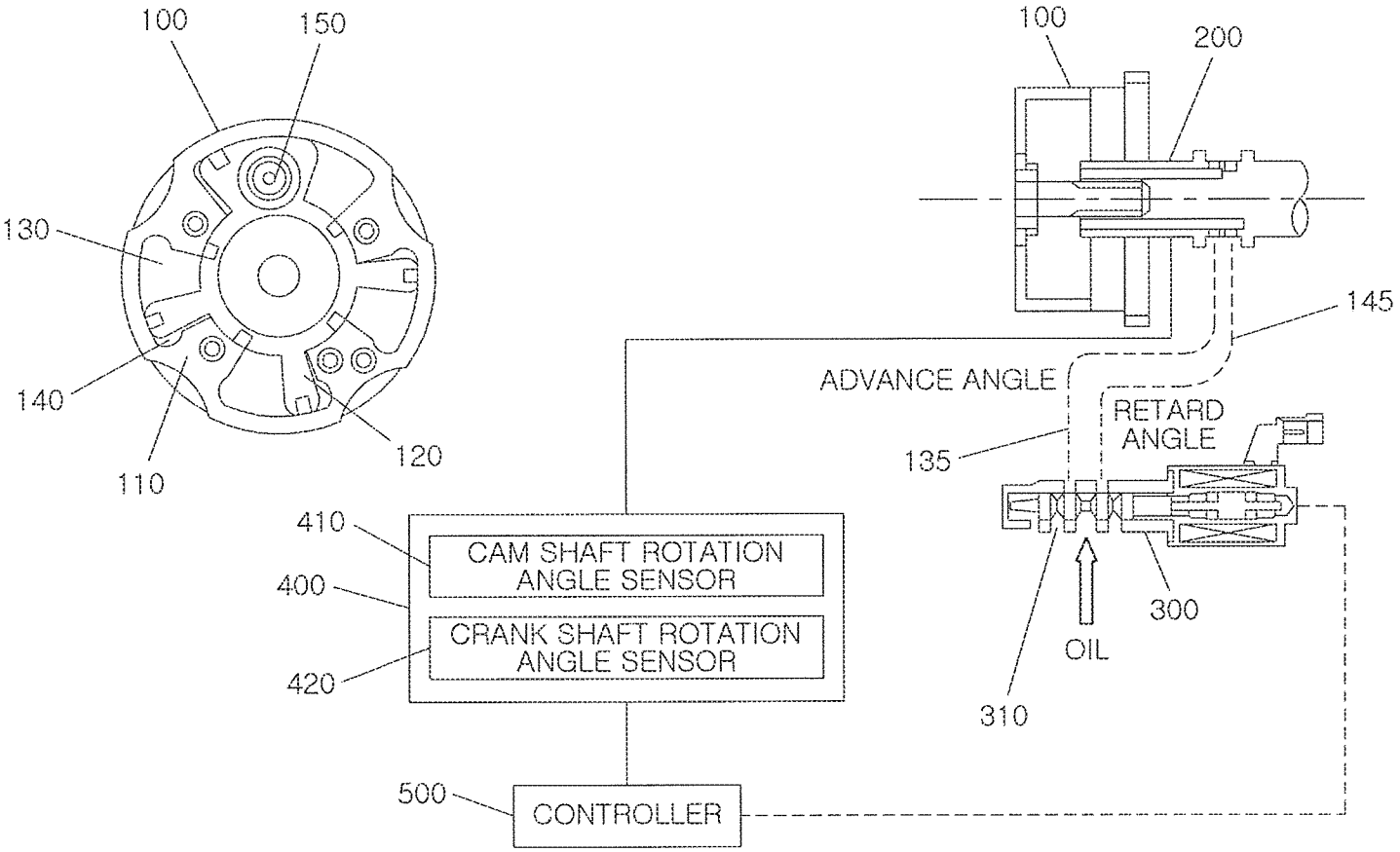
FIG. 1 is a diagram illustrating a configuration of a continuously variable valve timing (CVVT) system to which a cleaning method according to the present disclosure is applicable.

FIG. 1 is a diagram illustrating a configuration of a CVVT system to which a cleaning method according to the present disclosure is applicable. Referring to FIG. 1, a CVVT mechanism includes a variable valve mechanism 100 connected to one end of a cam shaft 200, an oil control valve 300, an engine status detector 400, and a controller 500. Here, the controller 500 includes an electronic control unit (ECU).

The variable valve mechanism 100 includes a housing 110, and a rotor vane 120 connected to one end of the cam shaft 200 of intake and exhaust valves (not shown) and inserted into an inner circumference of the housing 110.

A plurality of advance angle chambers 130 and a plurality of retard angle chambers 140, each of which is a space that is partitioned by each of a plurality of vanes of the rotor vane 120, are formed inside the housing 110. Further, a lock mechanism 150 is formed on at least a portion of the plurality of vanes of the rotor vane 120 to fix a rotation phase of the cam shaft 200 at a specific angle with respect to a crank shaft (not shown) of an internal combustion engine.

In the CVVT system, a spool 310 of the oil control valve 300 is controlled according to a control duty of the controller 500 so that a supply amount of oil is adjusted, the oil being supplied from the oil control valve 300 to the plurality of advance angle chambers 130 and the plurality of retard angle chambers 140 of the variable valve mechanism 100 through an advance angle flow path 135 and a retard angle flow path 145. With such operations, the rotation phase of the cam shaft 200 with respect to the crank shaft is changed between a maximum advance angle phase and a maximum retard angle phase such that a valve timing is varied.

More particularly, when the valve timing is changed to an advance angle mode, the oil control valve 300 blocks the retard angle flow path 145 through which the oil is supplied to the plurality of retard angle chambers 140, and opens the advance angle flow path 135 toward the plurality of advance angle chambers 130 according to a duty control to supply the oil to the plurality of advance angle chambers 130 and thus vary a pressure of the oil thereinside, thereby varying a phase of the cam shaft 200 into an advance angle.

When the valve timing is changed to a retard angle mode, the oil control valve 300 blocks the advance angle flow path 135 through which the oil is supplied to the plurality of advance angle chambers 130, and opens the retard angle flow path 145 toward the plurality of retard angle chambers 140 according to a duty control to supply the oil to the plurality of retard angle chambers 140 and thus vary a pressure of the oil thereinside, thereby varying the phase of the cam shaft 200 into a retard angle.

The controller 500 calculates an optimal valve timing based on a rotation region of an engine and sets a target valve timing based on the calculated optimal valve timing. Further, to reach the target valve timing, the controller 500 calculates a required rotation phase variation angle of the cam shaft 200 and controls the oil control valve 300 based on the calculated rotation phase variation angle.

In the case immediately after starting of a vehicle, the oil control valve 300 is difficult to supply a sufficient amount of the oil to the variable valve mechanism 100. In this case, the rotor vane 120 rotates due to variable torque that is applied from the intake valve or the exhaust valve to the variable valve mechanism 100 through the cam shaft 200 such that there is a concern in which the rotation phase of the cam shaft 200 may be significantly varied.

Consequently, in the CVVT mechanism according to the present disclosure, the lock mechanism 150 is provided at some vanes of the rotor vane 120 to enable to fix the rotation phase of the cam shaft 200 at a specific angle between a maximum advance angle and a maximum retard angle when a valve timing control is not required.

Further, the engine status detector 400 includes a cam shaft rotation angle sensor 410 configured to detect a rotation angle of the cam shaft 200, and a crank shaft rotation angle sensor 420 configured to detect a rotation angle of the crank shaft.

The controller 500 may receive a rotation angle of the cam shaft 200 and a rotation angle of the crank shaft from the cam shaft rotation angle sensor 410 and the crank shaft rotation angle sensor 420, respectively, and then subtract the rotation angle of the crank shaft from the rotation angle of the cam shaft 200, thereby calculating an actual variation angle of a valve timing due to the CVVT mechanism.

When foreign materials contained in the oil are stacked inside the oil control valve 300 or oil flow paths of the CVVT system, the CVVT system does not operates smoothly so that the controller 500 moves the spool 310 of the oil control valve 300 within a predetermined range according to a control signal transmitted to the oil control valve 300 and performs cleaning to remove various kinds of the foreign materials which are stacked between oil flow paths and the spool 310 inside the oil control valve 300. In order to optimize removal efficiency of the foreign materials, the spool 310 may be repetitively switched between a full closed position (that is, a duty cycle of 0%) and a full open position (that is, a duty cycle of 100%) by a predetermined number of times.

In a certain embodiment, at the full closed position of the spool 310, the controller 500 may control a duty cycle of the control signal applied to the oil control valve 300 to 0% (that is, a low duty cycle). Further, at the full open position of the spool 310, the controller 500 controls the duty cycle of the control signal applied to the oil control valve 300 to 100% (that is, a high duty cycle). The controller 500 alternately switches the duty cycle between 0% and 100% to repetitively move the spool 310 of the oil control valve 300 by a predetermined number of times, thereby performing a cleaning mode.

Figure 2:
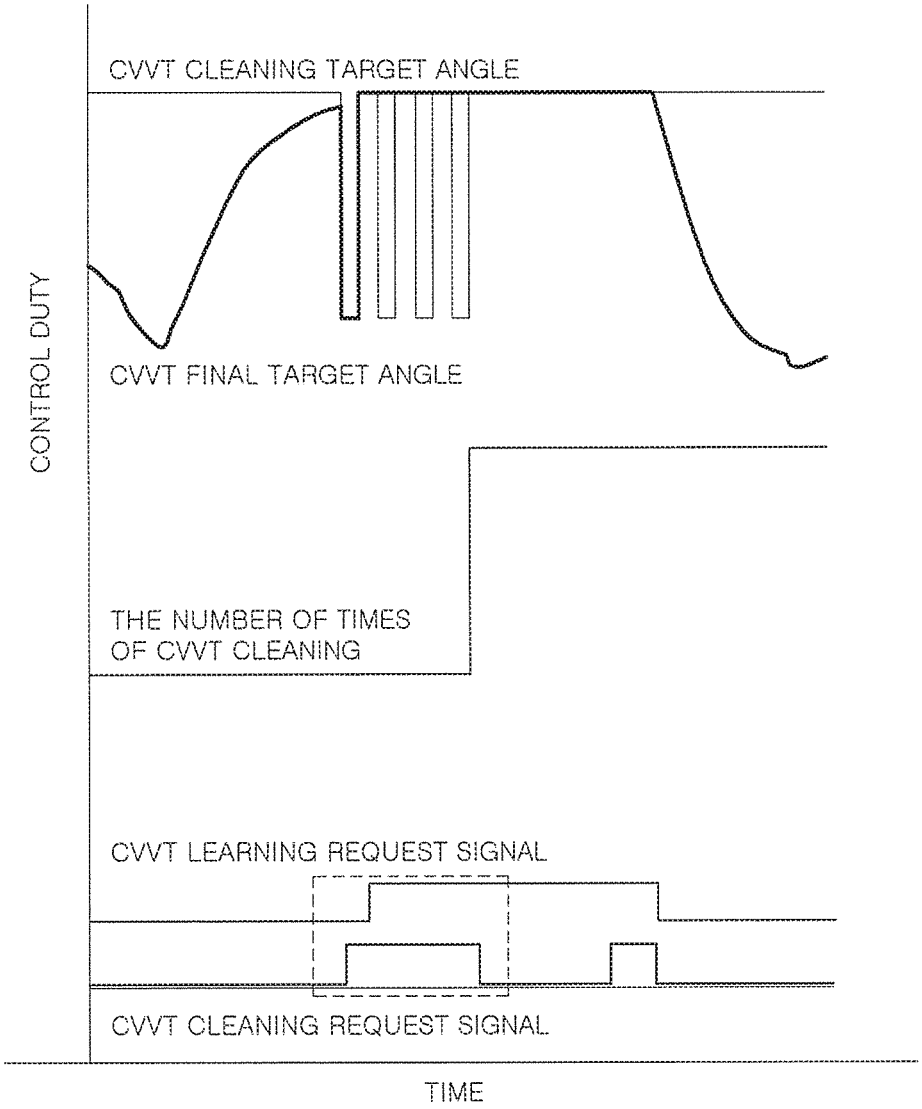
FIG. 2 is a signal diagram when a method for cleaning a CVVT system according to the related art is performed.

For example, in an example shown in FIG. 2, the duty cycle of 0% and the duty cycle of 100% are alternately repetitively switched four times. Further, when the duty cycle is switched by a predetermined number of repetition times, the controller 500 increases a counter representing the number of times the cleaning is performed. In addition, after the cleaning is performed by the predetermined number of times, the controller 500 determines that the foreign materials are sufficiently removed, and does not perform the cleaning any longer.

Figure 3:
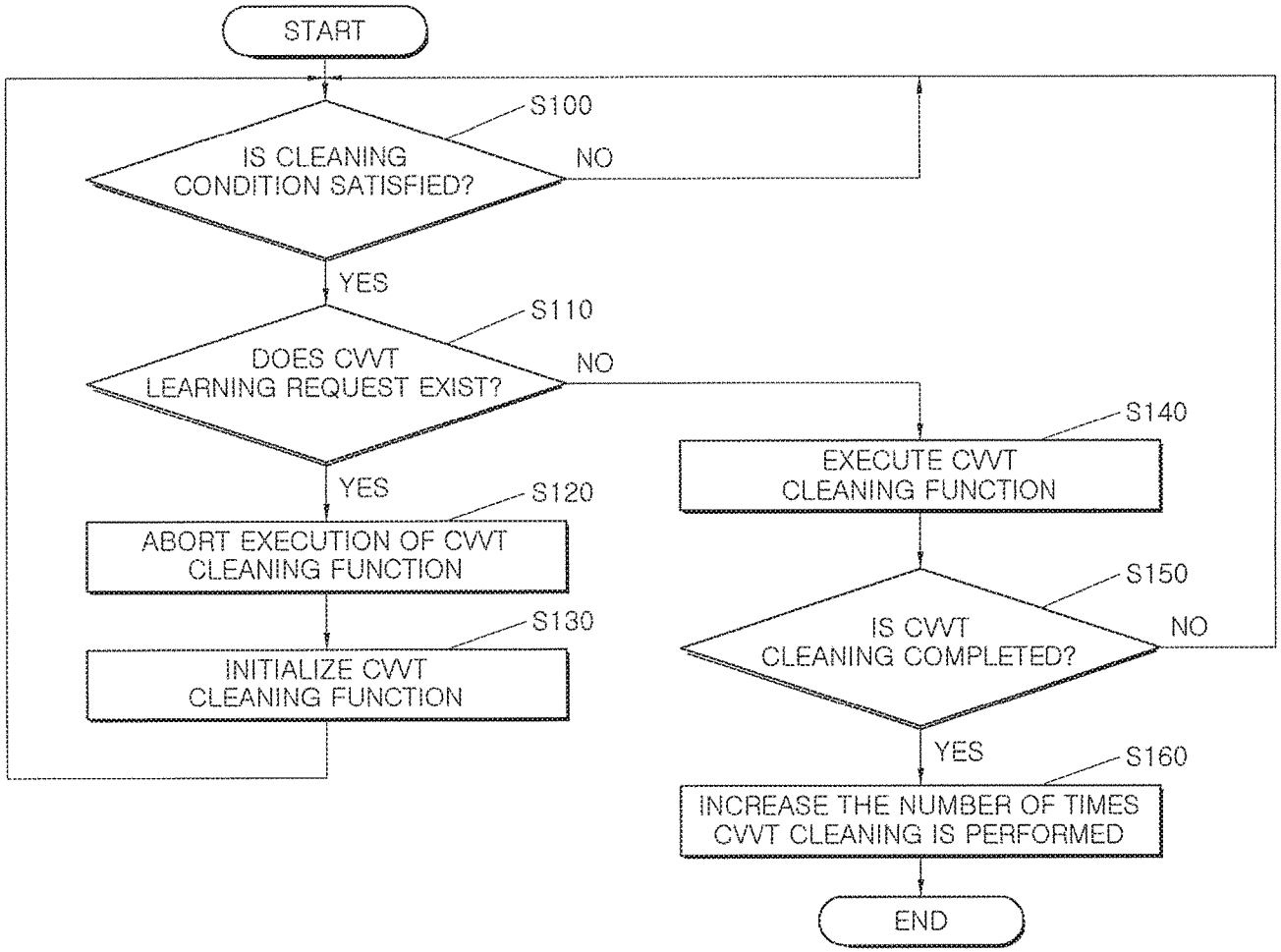
FIG. 3 is a flowchart illustrating an exemplary embodiment of the method for cleaning a CVVT system according to the present disclosure.

FIG. 3 is a flowchart illustrating an exemplary embodiment of a method for cleaning a CVVT system according to the present disclosure.

Referring to FIG. 3, to perform cleaning of a CVVT system, the controller 500 first determines whether a predetermined cleaning condition is satisfied (S100). The predetermined cleaning condition refers to an operating condition suitable for performing the cleaning of the oil control valve 300 of the CVVT system, and a cleaning condition may be at least one of a key-on state, a key-off state, and a fuel cut-off state.

When the CVVT system is determined to correspond to one condition of the above-described cleaning conditions by the controller 500, the controller 500 determines whether a valve timing control learning request exists for the CVVT system (S110).

At this point, the valve timing control learning refers to learn a relationship between a control duty of the controller 500 for controlling the oil control valve 300 and an actual phase of the cam shaft 200 at that control duty. The valve timing control learning of the CVVT system may be performed by varying a duty ratio of the oil control valve 300 to adjust a target rotation phase of the cam shaft 200 by the CVVT system to a target learning phase, and then detecting an actual rotation phase of the cam shaft 200 through the engine status detector 400, thereby learning a relationship between a duty ratio of the oil control valve 300 and a rotation phase of the cam shaft 200 in a corresponding operating region. Here, the target rotation phase is a point that becomes a reference position for determining variation of the valve timing, and in a certain embodiment, it may be a phase that corresponds to a mechanical stop position of a valve lift.

When an operating condition for the valve timing control learning is similar to that when the cleaning is performed, as shown in FIG. 2, there occurs a case in which the valve timing control learning request exists while the cleaning is performed.

Figure 4:
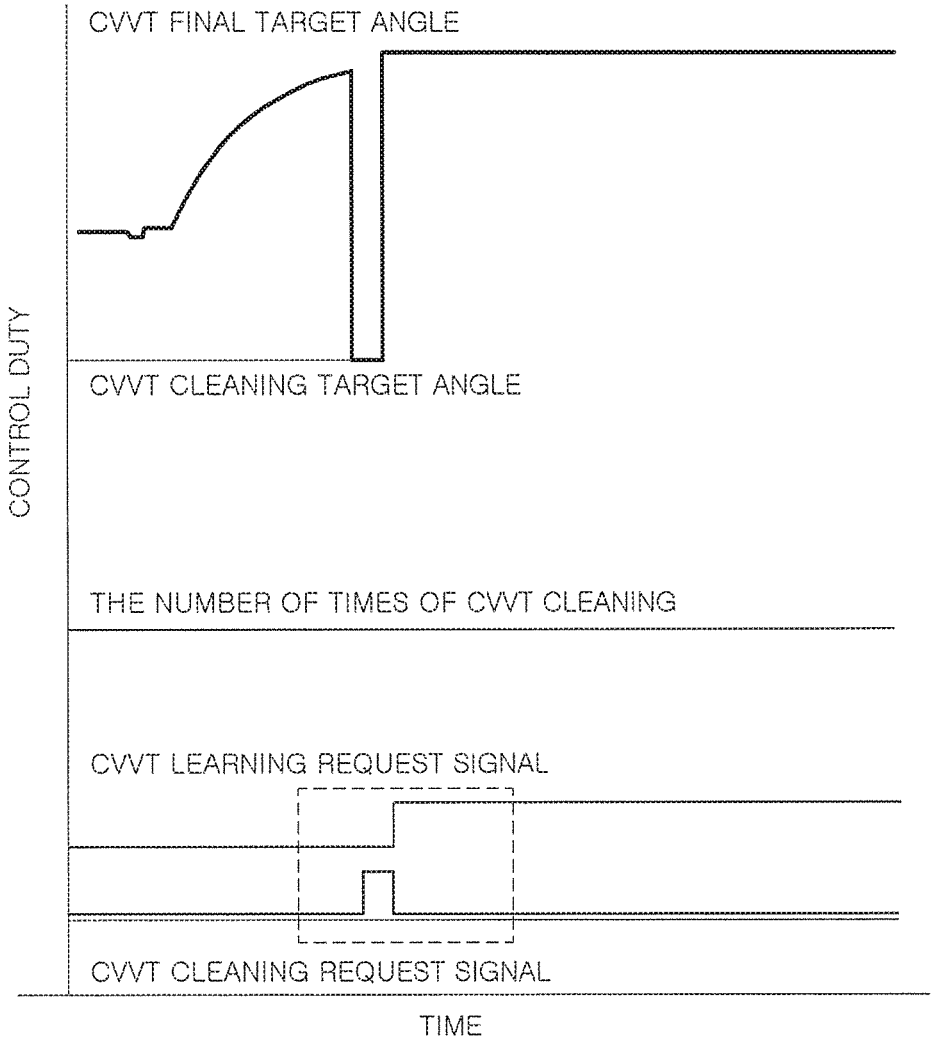
FIG. 4 is a signal diagram when the method for cleaning a CVVT system according to the present disclosure is performed.

While the cleaning is performed, the controller 500 continuously verifies whether the valve timing control learning request as described above exists, and, when the valve timing control learning request exists while the cleaning is performed, as shown in FIG. 4, the controller 500 aborts the cleaning (S120).

When the valve timing control learning request and a cleaning request exist at the same time, the valve timing control learning request may be performed. Consequently, as shown in FIG. 2, a target control phase (that is, an angle) of the CVVT is adjusted to and determined by a target phase for the valve timing control learning instead of a target phase for the cleaning. Therefore, a final control phase (that is indicated with a bold line in FIG. 2) of the CVVT is different from the target phase for the cleaning. However, in a cleaning method according to the related art, the controller 500 does not recognize the above-described situation and verifies only a control duty (that is, the target phase) for the cleaning to determine that the cleaning is performed normally, thereby increasing the number of times the cleaning is performed. As a result, even though the cleaning is not actually performed, the number of times the cleaning is performed is meaninglessly increased such that there is a problem in that an actual number of times the cleaning is performed is decreased.

Therefore, the present disclosure determines whether the valve timing control learning request and the cleaning request exist at the same time, and, when the valve timing control learning request exists, it aborts the cleaning (S120) and further initializes all variables related to the cleaning, for example, the number of switching times of the duty cycle, and the like (S130).

In this case, as shown in FIG. 4, after the cleaning request exists for the oil control valve 300 of the CVVT system, even when a valve timing request exists and thus the valve timing control learning is performed, the number of times the cleaning is performed is not increased.

Meanwhile, alter the valve timing control learning request exists for the CVVT system and thus the cleaning is aborted, when a corresponding valve timing control learning is determined to be aborted, the cleaning may be resumed to rapidly remove foreign materials.

On the other hand, when the valve timing control learning request for the CVVT system is determined not to exist, the controller 500 alternately repetitively switches the high duty cycle and the low duty cycle of the control signal applied to the oil control valve 300 by one times and over, that is, by a predetermined number of times, and controls to move a position of the spool 310 of the oil control valve 300 within a predetermined section by the predetermined number of times and over to thereby perform the cleaning (S140).

Further, the controller 500 determines whether the switching between the high duty cycle and the low duty cycle of the control signal corresponding to the target phase is performed by the predetermined number of times, and thus determines whether the cleaning of the CVVT system is completed (S150).

When the cleaning of the CVVT system is determined to be completed, the controller 500 aborts controlling of the CVVT for the cleaning and increases the number of times the cleaning is performed. The controller 500 may determine whether the number of times the cleaning has been performed so far reaches the predetermined number of times, and then determine whether to perform additional cleaning.

When the cleaning of the CVVT system is determined not to be completed, the controller 500 continuously controls the valve timing of the CVVT system for the cleaning and consistently verifies whether the valve timing control learning request exists.

In accordance with the present disclosure, while the cleaning of the CVVT system is performed, when the valve timing control learning request exists for the CVVT system, the cleaning is aborted and, after the valve timing control learning is completed, the cleaning is resumed such that a problem of an imbalance between an actual number of times the cleaning is performed and a counted number of times the cleaning is performed may be resolved. Through such operations, removal efficiency of the foreign materials is improved such that a problem in durability degradation of the oil control valve 300 can be effectively managed.

In accordance with the present disclosure, whether to perform the valve timing control learning for the CVVT system is considered while the cleaning for the CVVT system is performed, so that the number of times the cleaning is performed is prevented from being meaninglessly counted even though the cleaning is not actually performed.

Through such an operation, the cleaning can be sufficiently performed to remove the foreign materials inside the oil control valve and thus durability of the oil control valve can be improved such that there is an effect in which vehicle maintenance costs can be reduced.

While the present disclosure has been described with respect to the specific embodiments, it will be apparent to those skilled in the art that various changes and modifications may be made without departing from the spirit and scope of the invention as defined in the following claims.

What is claimed is:

1. A method for cleaning a continuously variable valve timing (CVVT) system for removing foreign materials, the method comprising steps of:

switching, by a controller, a target operating value of the CVVT system to a predetermined setting value within a set operating region and cleaning the CVVT system; and determining, by the controller, whether a valve timing control learning request exists for the CVVT system, and aborting the cleaning when the valve timing control learning request exists, wherein, when the cleaning is completed, a counter representing a number of times the cleaning is performed is increased, wherein the cleaning is performed a predetermined number of times in a predetermined operating region of the engine, wherein, when the number of times the cleaning is performed exceeds the predetermined number of times, the cleaning is aborted for more than a predetermined period of time, and wherein, when the cleaning is aborted due to the valve timing control learning request, the number of times the cleaning is performed is not counted.

2. The method of claim 1, wherein, in the step of cleaning, the controller moves a spool of an oil control valve within a predetermined section between a full closed position and a full open position in the oil control valve by a predetermined number of times according to a control signal applied to the oil control valve of the CVVT system to clean the oil control valve.

3. The method of claim 1, further comprising:

determining, by the controller, whether a cleaning condition is satisfied before the cleaning is performed.

4. The method of claim 1, wherein, when the valve timing control learning request exists and the cleaning is aborted, variables related to the cleaning are initialized.

5. The method of claim 1, wherein whether the valve timing control learning request exists is continuously determined while the cleaning is performed, and when the valve timing control learning request exists while the cleaning is performed, the performing of the cleaning is aborted.

6. The method of claim 1, wherein a valve timing control learning for the CVVT system is performed by varying a duty ratio of an oil control valve to adjust a target rotation phase of a cam shaft by the CVVT system to a target learning phase and detecting an actual rotation phase of the cam shaft, so that a relationship between the varied duty ratio of the oil control valve and the detected actual rotation phase of the cam shaft in a corresponding operating region is identified.

7. The method of claim 1, wherein, while the cleaning is performed, a high duty cycle and a low duty cycle of a control signal applied to an oil control valve are alternately switched by once or more so that a position of a spool of the oil control valve moves within a predetermined section by a predetermined number of times or more.

8. The method of claim 1 comprising:

determining, by the controller, whether a switching between a high duty cycle and a low duty cycle is performed by a predetermined number of times after the cleaning is performed.

9. The method of claim 1, wherein, after the valve timing control learning request exists for the CVVT system and the cleaning is aborted, the cleaning is resumed when a valve timing control learning is determined to be terminated.

10. The method of claim 6, wherein the target learning phase in the valve timing control learning for the CVVT system is a phase corresponding to a mechanical stop position of a valve lift that is controlled by the CVVT system.

11. The method of claim 6, wherein, when the valve timing control learning request exists for the CVVT system while the cleaning is performed, a final target phase of the CVVT system is determined based on the target learning phase in the valve timing control learning.

12. The method of claim 6, wherein the valve timing control learning for the CVVT system is performed in a preset operating region of an engine.

* * * * *